United States Patent [19]

Jones

[11] Patent Number: 4,627,363

[45] Date of Patent: Dec. 9, 1986

[54] TABLE COVERING APPARATUS

[76] Inventor: Juliana C. Jones, 1025 Fisk St., Scranton, Pa. 18509

[21] Appl. No.: 732,602

[22] Filed: May 10, 1985

[51] Int. Cl.[4] ..... A47B 13/08

[52] U.S. Cl. ..... 108/90; 428/100; 150/52 R; 52/3

[58] Field of Search ..... 428/100; 150/52 R; 52/3, 4, DIG. 13; 2/DIG. 6; 108/90

[56] References Cited

U.S. PATENT DOCUMENTS

| | | | |
|---|---|---|---|
| 2,734,543 | 2/1956 | Hunter | 150/52 R |
| 2,904,128 | 9/1959 | Boham et al. | 150/52 R |
| 3,221,959 | 12/1965 | Southwick | 150/52 R |

*Primary Examiner*—Alexander S. Thomas

*Attorney, Agent, or Firm*—Anthony J. Dixon

[57] ABSTRACT

An apparatus for securing a table covering to a table wherein the covering is easily releasable and convenient to engage. Various shaped and sized tables can be accommodated by an apparatus utilizing a series of opposing pairs of strips releasably attached to a location underneath one edge of the table.

5 Claims, 4 Drawing Figures

TABLE COVERING APPARATUS

BACKGROUND OF THE INVENTION

1. Field of the Invention

The present invention relates generally to the field of furniture and furniture coverings.

More particularly, it relates to the field of tables and table coverings.

More particularly it relates to an easily releasable table covering apparatus for particular use in securing various shaped table coverings or table cloths to tables of various shapes.

2. The Prior Art

Table coverings are well known and the field of art is old. However, the increased use of outdoor dining and the mobility of the present society has created a need for particular types of table coverings.

Prior attempts to meet this need can be seen in U.S. Pat. No. 1,219,790 issued to Robert G. Taylor. That invention relates to a readily reversible table cover which employs a drawstring around the table base yet it is most applicable to pedestal type tables which are not particularly favored at present. such as the device set forth in U.S. Pat. No. 3,858,256 issued to Andrew E. Beer wherein a closeable split in the marginal portion of bedclothes is drawn together and closed by a plurality of hook-loop or hook-pile fasteners. No disclosure is made or suggested as to the applicability of any aspect of the Beer reference to other furniture.

Therefore the problem still exists in the art to provide a convenient and easily releasable tablecloth or table covering for use indoors as well as outdoors in our mobile modern society.

SUMMARY OF THE INVENTION

These and other shortfalls and problems in the art are addressed and solved by the present invention which has as its primary object to provide a table covering which is easily and conveniently releasable.

It is a further object of the present invention to provide an apparatus which can be adopted to many shapes and types of tables including but not limited to square, rectangular, round, oval, hexagonal, pedestal legged, four legged, six legged and the like.

It is a further subject of the present invention to provide a table covering which is easily releasable without the need to crawl under the table to do so.

These and other objects and advantages are achieved by the present apparatus for securing a table covering to a table in combination with the table comprising:

a. a table covering with opposing edges such as a cloth or plastic at a length and width larger than the table to be covered;

b. a first set for strips mounted to the underside of said covering and extending outwardly therefrom;

c. a second set of strips mounted to the underside of said table and extending outwardly therefrom in directions opposing said first set, each strip of a length essentially larger than said first strips;

d. means for attaching the ends of the strips together;

Whereby the table is covered and said first strips are attached end on end to said second strips thereby securing said cloth to said table.

It is further envisioned that the length of the strips will be chosen so as to cause the connection to be at a location adjacent to one edge of the table. In this way the user need not move under the table to connect or disconnect the strips. Connections such as snap or hook-pile fasteners are preferred.

The invention will be more clearly understood upon review of the drawings and description of the Preferred Embodiment which follows.

DESCRIPTION OF THE PREFERRED EMBODIMENT

Figure 1:
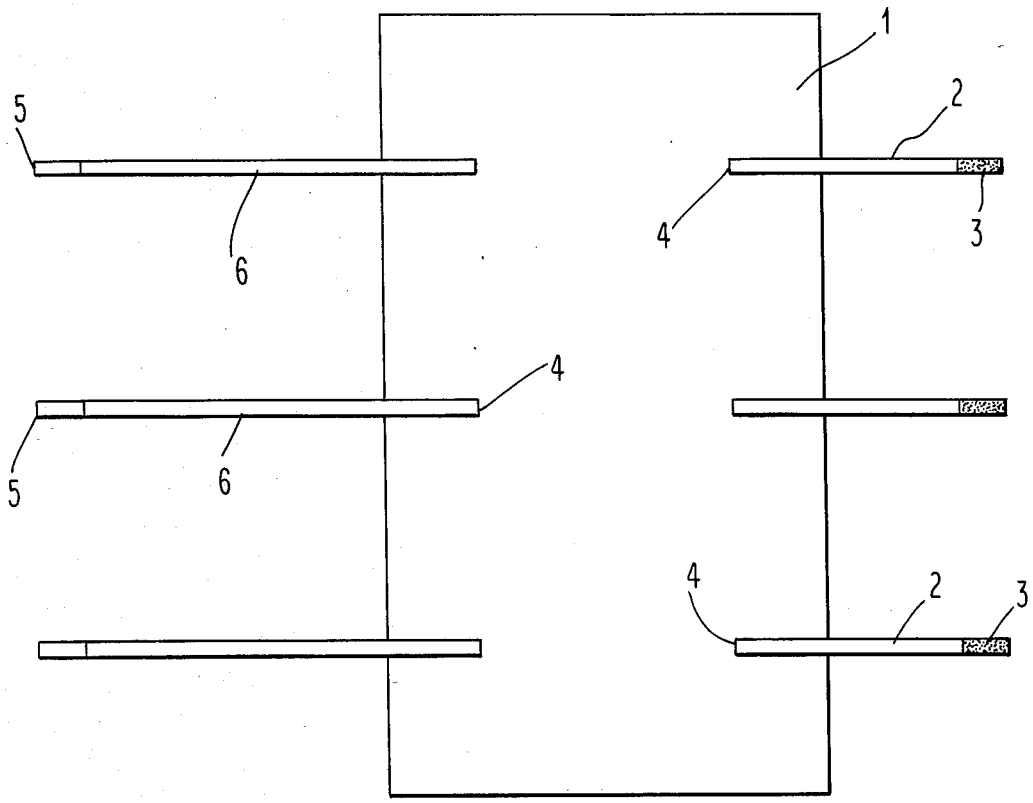
FIG. 1 is a plane underside view of the invention uninstalled.

With reference to FIG. 1, the apparatus of the present invention for a rectangular application is shown.

The main body of the invention is cloth or covering 1 to which are attached two opposing sets of strips, 2 and 6.

Figure 2:
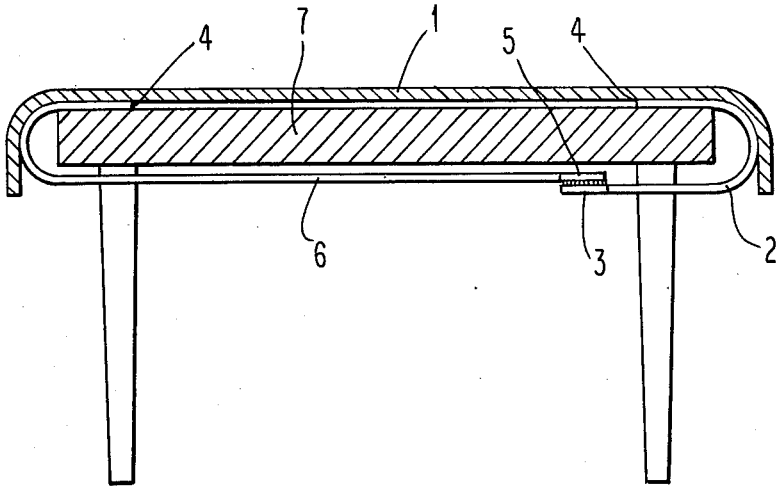
FIG. 2 is a cross-sectional view showing the invention in relationship to a given table.
Figure 3:
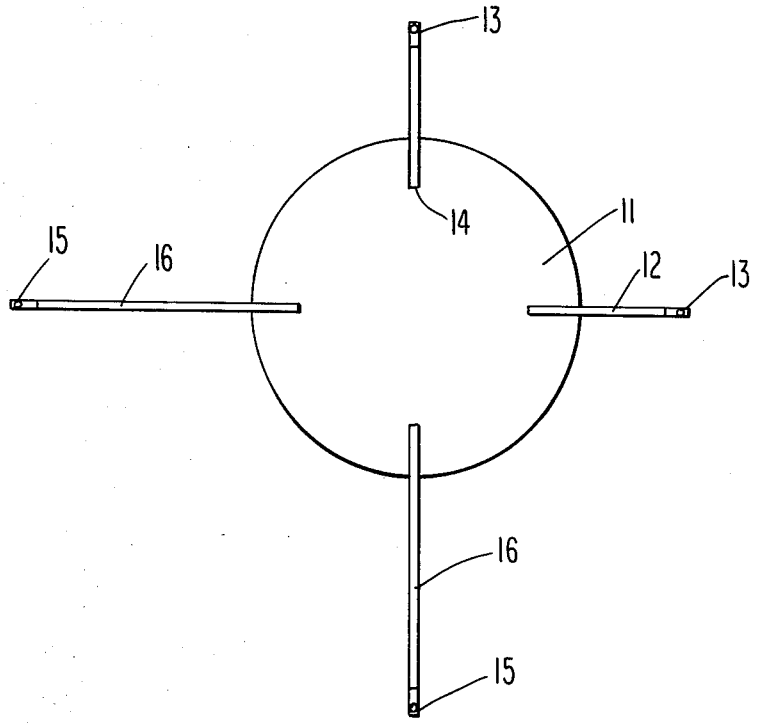
Figure 4:
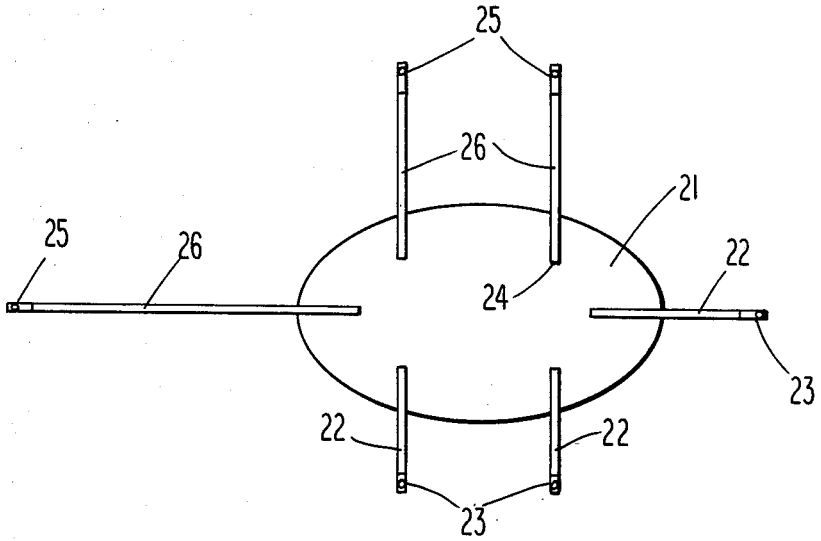

The first set of strips, 2, are each attached to the body 1 in a fixed manner at location 4. This allows the covering to drape as shown in FIG. 2. Each strip is of a length to pass around the edge of the table 7 (see FIG. 2) and to extend underneath at least enough to allow fasteners 3 to be underneath the table.

The second set of strips are essentially longer than the first set of strips 2 so that each of them passes around the edge of table 7 and extends a length necessary to bring fasteners 5 in contact with fasteners 3.

In this fashion, the connection is at a location convenient to the user.

The fasteners 3 and 5 can be from the group consisting of snaps, hook-pile, adhesive or the like so as to be releasable for multiple uses. The strips and fasteners are preferably produced from colorfast and non-rusting materials so as not to cause change to the cloth during cleaning of same.

It is envisioned that the strips will be produced in sets to allow the consumer to select the number and size necessary to accommodate a given shape and size of cloth. Total cloth and strip combinations are preferred however.

Various modifications are possible without departing from the scope of the present invention. Changes in the number of strips used or the shape of the cloth are not deemed beyond the scope of the present invention.

I claim:

1. An apparatus for covering a table in combination with a table comprising a. a table covering with first and second opposing edges with dimensions accommodatingly larger than the table;

b. a first set of strips attached on one end to the underside of said covering adjacent to the first edge; and aligned with the table edge and extending on the other end outwardly therefrom;

c. a second set of strips attached on one end to the underside of said covering adjacent to the second edge opposing the first edge; and aligned with the table edge and extending, on the other end, outwardly therefrom in a direction opposing said first set for strips and of a length essentially longer than said first set of strips;

d. means for attaching the end of each first strip to the end of each opposing second strip;

whereby the table is covered and said strips are attached end to end at a location unseen under said table thereby securing the covering thereto while allowing the table covering to drape.

2. The apparatus of claim 1 wherein said means for attaching the ends of the first and second strips is selected from the group consisting of hook-pile fasteners and snaps.

3. The apparatus of claim 2 wherein said body is rectangular.

4. The apparatus of claim 2 wherein said body is circular.

5. The apparatus of claim 2 wherein said body is oval shaped.

* * * * *